US009696669B2

(12) United States Patent
Uehashi et al.

(10) Patent No.: US 9,696,669 B2
(45) Date of Patent: Jul. 4, 2017

(54) FUSER DEVICE AND IMAGE FORMING APPARATUS

(71) Applicant: Oki Data Corporation, Tokyo (JP)

(72) Inventors: Tetsuya Uehashi, Tokyo (JP); Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/074,630

(22) Filed: Mar. 18, 2016

(65) Prior Publication Data

US 2016/0320730 A1 Nov. 3, 2016

(30) Foreign Application Priority Data

Apr. 28, 2015 (JP) ..... 2015-091618

(51) Int. Cl.
*G03G 15/20* (2006.01)

(52) U.S. Cl.
CPC . *G03G 15/2053* (2013.01); *G03G 2215/2022* (2013.01)

(58) Field of Classification Search
None
See application file for complete search history.

(56) References Cited

U.S. PATENT DOCUMENTS

2006/0127142 A1* 6/2006 Nakamoto ..... G03G 15/2053 399/329
2010/0150624 A1* 6/2010 Yamamoto ..... G03G 15/2053 399/329

FOREIGN PATENT DOCUMENTS

JP 2013-041183 A 2/2013

* cited by examiner

*Primary Examiner* — David M Gray
*Assistant Examiner* — Thomas Giampaolo, II
(74) *Attorney, Agent, or Firm* — Muncy, Geissler, Olds & Lowe, P.C.

(57) ABSTRACT

A fuser device is provided with a first endless belt, a heat application member that is enclosed by the first endless belt and heats the first endless belt, a fuser member enclosed by the first endless belt, a second endless belt of which rigidity is higher than that of the first endless belt, a pressure application member that is enclosed by the second endless belt and applies a pressure to developers on a carried recording medium in the contact part with the fuser member, and a support part forming part that forms a support part of the first endless belt and the second endless belt.

18 Claims, 9 Drawing Sheets

FUSER DEVICE AND IMAGE FORMING APPARATUS

CROSS REFERENCE TO RELATED APPLICATIONS

This application claims priority under 35 USC 119 to Japanese Patent Application No. 2015-091618 filed on Apr. 28, 2015, the entire contents which are incorporated herein by reference.

TECHNICAL FIELD

This invention relates to a fuser device and an image forming apparatus and is applicable to fuser devices and image forming apparatuses used for printers, copiers, facsimile machines, etc. that adopted an electrophotographic system for example.

BACKGROUND

For example, as in the art according to Patent Document 1, a fuser device that adopted a belt system disposes a belt between a heat application member (such as a heat application roller) and a pressure application member (such as a pressure application roller). The pressure application member is disposed so as to be enclosed by the belt, and the pressure application member forms a fuser nip part to the heat application member through the belt.

RELATED ART

[Patent Document 1] Unexamined Japanese Patent Application 2013-41183

By the way, it is desired that image forming apparatuses reduce the image forming time and increase the recording medium carrying speed by reducing the belt thickness of the fuser device.

However, accompanying the reduction of the belt thickness, there possibly occur unevenness in the nip pressure, unevenness in heat application, etc. in the fuser nip part, which cause insufficient fusion of images onto a recording medium, possibly inducing fusion failures such as image quality degradation.

Also, if an attempt to secure the nip length (contact area) of the fuser nip part is made in order to maintain secure fusion, there possibly occur abnormalities of the fuser device itself such as an increase in the drive load in driving the belt, causing image quality degradation, fuser device failures, and the like.

Therefore, desired are a fuser device and an image forming apparatus that can provide high quality images while sufficiently securing pressure application and heat application and preventing fuser device failures.

SUMMARY

A fuser device disclosed in the application is provided with a first endless belt, a heat application member that is enclosed by the first endless belt and heats the first endless belt, a fuser member enclosed by the first endless belt, a second endless belt of which rigidity is higher than that of the first endless belt, a pressure application member that is enclosed by the second endless belt and applies a pressure to developers on a carried recording medium in the contact part with the fuser member, and a support part forming part that forms a support part of the first endless belt and the second endless belt.

An image forming apparatus disclosed in the application is provided with one or more development devices that transfer a developed developer image to a recording medium, and the fuser device described above that fuses the developer image on the recording medium from the one or more development devices to the recording medium.

According to this invention, high quality images can be provided while sufficiently securing pressure application and heat application and preventing fuser device failures.

DETAILED DESCRIPTION OF PREFERRED EMBODIMENT(S)

(A) First Embodiment

Below, the first embodiment of a fuser device and an image forming apparatus of this invention is explained in detail referring to drawings.

Illustrated in the first embodiment is a case of applying this invention to an image forming apparatus that adopted an electrophotographic system and a fuser device of a belt system.

Figure 2:
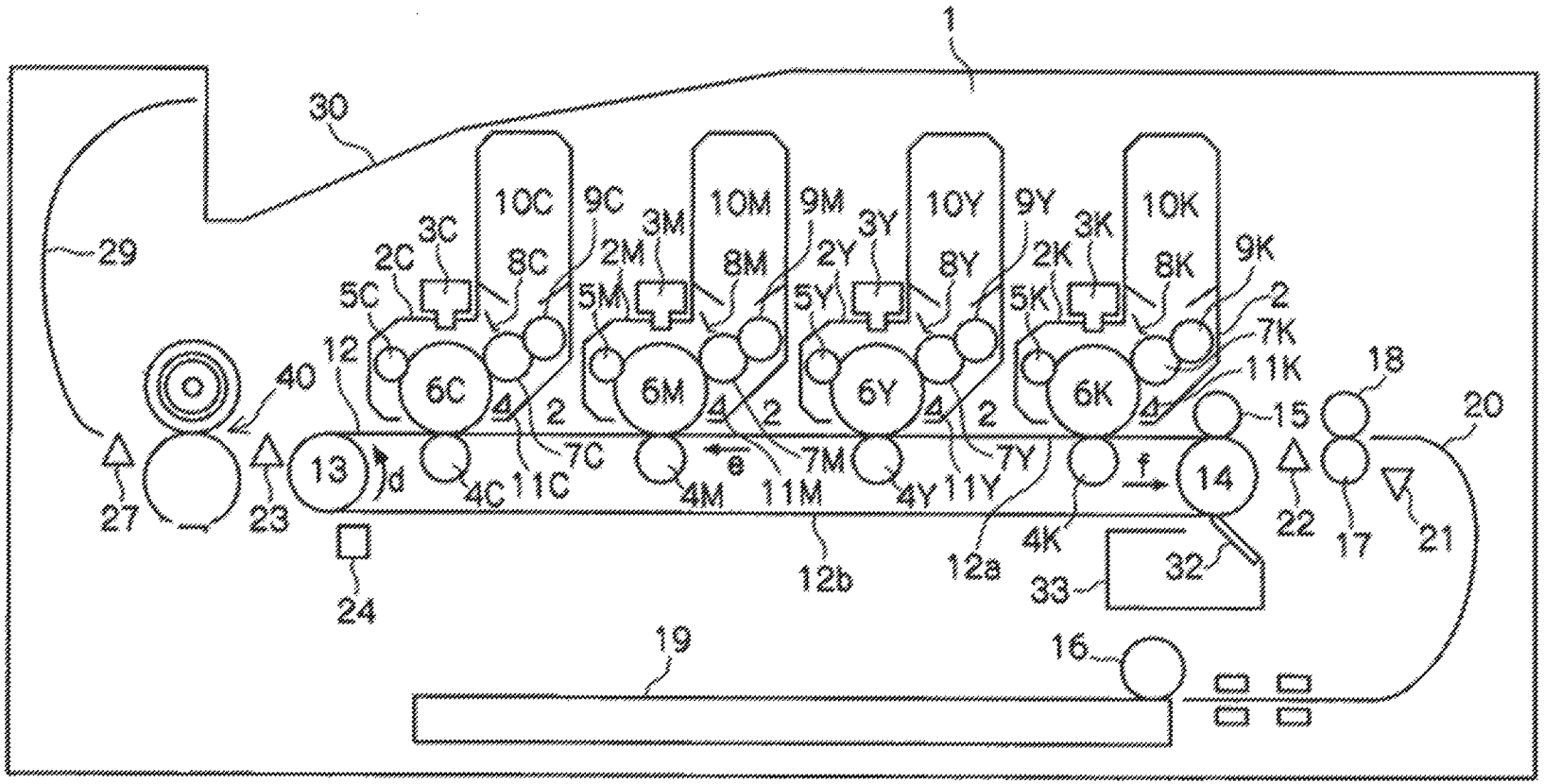
FIG. 2 is an internal configuration diagram showing the internal mechanical configuration of an image forming apparatus of the first embodiment.

(A-1) Configuration of the First Embodiment (A-1-1) Configuration of the Image Forming Apparatus FIG. 2 is an internal configuration diagram showing the internal mechanical configuration of an image forming apparatus of the first embodiment. Note that omitted in FIG. 2 is an electric configuration such as an operation part, a display part, and a control part.

In FIG. 2, an image forming apparatus 1 of the first embodiment comprises development devices 2K, 2Y, 2M, and 2C as image forming units using four different color developers (black (K), yellow (Y), magenta (M), and cyan (C)).

The development devices 2K, 2Y, 2M, and 2C are each disposed along a carrying path where a recording medium is carried. Note that although there are no particular limitations on the arrangement of the development devices 2K, 2Y, 2M, and 2C, illustrated in FIG. 2 is a case where they are disposed in the order of the development devices 2K, 2Y, 2M, and 2C from the upstream side to the downstream side in the carrying direction of the recording medium.

Although the development devices 2K, 2Y, 2M, and 2C have each different colors of their toners as developers, their mechanical components are common. Representing the development devices 2K, 2Y, 2M, and 2C, the configuration of the development device 2K is explained.

For example, the development device 2K comprises a charging roller 5K, a photosensitive drum 6K as an image carrier whose surface is uniformly charged by this charging roller 5K, an LED head 3K as an exposure device that forms an electrostatic latent image on the photosensitive drum 6K, a development roller 7K for developing the electrostatic latent image into a toner image, a toner cartridge 10K as a developer containing part that contains a toner as a developer that contains a coloring agent of the corresponding color component, and a development blade 8K and a sponge roller 9K for charging and supplying the toner to the development roller 7K.

Provided adjacent to the photosensitive drums 6K-6C are transfer rollers 4K-4C as transfer parts to which charged is a voltage for transferring the toner images on the photosensitive drums 6K-6C to the recording medium. A carrying belt 12 is rotatably disposed between the photosensitive drums 6K-6C and the transfer rollers 4K-4C.

The carrying belt 12 is formed in a seamless and endless belt shape and looped over between a drive roller 13 and a driven roller 14. The drive roller 13 is provided in the downstream side of the driven roller 14 in the carrying direction of the recording medium. The drive roller 13 rotates in the arrow d direction by receiving drive from a drive part such as a belt motor for example and runs the upper side of the carrying belt 12 disposed between the photosensitive drums 6K-6C and the transfer rollers 4K-4C in the arrow e direction.

Also, provided in the lower part (lower-right side in FIG. 2) inside the image forming apparatus 1 is a sheet feeding mechanism for supplying the recording medium to the carrying path. This sheet feeding mechanism comprises a hopping roller 16, a registration roller 17, and a recording medium accommodating cassette 19.

The recording medium accommodating cassette 19 accommodates the recording medium. The accommodated recording medium is selected one piece at a time by an unshown separation means, taken out of the recording medium accommodating cassette 19 by the hopping roller 16, and guided by a guide 20 to reach the registration roller 17. Skew (running speed fluctuation) of the recording medium is corrected by the registration roller 17 and a pinch roller 18 facing with the registration roller 17.

The recording medium that reached the registration roller 17 is afterwards guided from the registration roller 17 to between an adsorption roller 15 and the carrying belt 12. The adsorption roller 15 contacts with, presses against, and charges the recording medium between it and the driven roller 14, and has the recording medium electrostatically adsorbed to the upper surface of the carrying belt 12.

Sensors 21 and 22 are each disposed in the vicinities of the carrying path before and after the registration roller 17 for detecting the presence of the recording medium in the vicinity of their set positions. Provided in the side of ejection from the carrying belt 12 on the drive roller 13 side is a sensor for checking the recording medium that failed to be separated from the carrying belt 12 or detecting the trailing edge position of the recording medium.

Separated from the carrying belt 12, the recording medium is guided to a fuser device 40 of the first embodiment.

The fuser device 40 heats and melts toners on the recording medium to fuse toner images on the recording medium. The details of the configuration of the fuser device 40 are described later.

Provided in the downstream side of the fuser device 40 is a sensor 27 that detects the ejection of the recording medium with the toner images fused from the fuser device 40. Provided in the downstream side of the sensor 27 is an ejection guide 29 that ejects the recording medium with the toner images fused to a recording medium receiving surface 30 outside the chassis of the image forming apparatus 1.

Contacting with the lower surface of the carrying belt 12 is a cleaning mechanism. The cleaning mechanism comprises a cleaning blade 32 and a waste toner tank 33. The driven roller 14 and the cleaning blade 32 are provided in positions opposing each other so as to nip the lower half 12*b* of the carrying belt 12. When the carrying belt 12 moves in the arrow f direction toward the driven roller 14, the cleaning blade 32 scrapes off residual toners adhering to the surface of the carrying belt 12 down to the waste toner tank 33.

(A-1-2) Configuration of the Fuser Device

Figure 1:
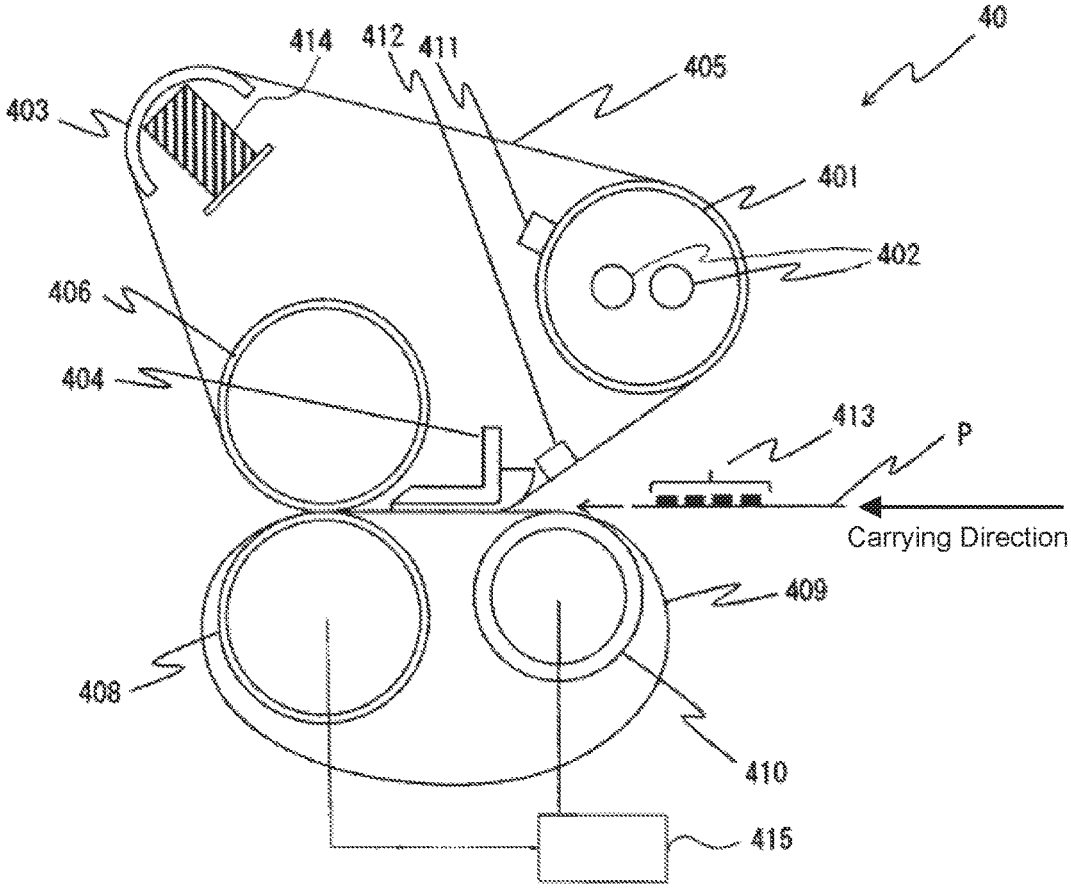
FIG. 1 is a configuration diagram showing the detailed configuration of a fuser device of the first embodiment.

FIG. 1 is a configuration diagram showing the detailed configuration of the fuser device 40 of the first embodiment.

In FIG. 1, the fuser device 40 of the first embodiment comprises a heat application roller 401 as a heat application member, a tension guide 403 as a heat equalization member, a fuser belt 405, a drive roller 406 as a fuser member, a pad 404 as a support part forming part, a pressure application belt 409, a pressure application roller 408 as a pressure application member, a support roller 410, temperature sensors 411 and 412, bias mechanisms 414, and a nip switching means 415.

The fuser belt 405 is an endless belt and rotates accompanying the rotation of the drive roller 406. The fuser belt 405 conducts heat applied by the heat application roller 401, and while rotating in a state of retaining the heat, it melts toners 413 mounted on a recording medium P.

Disposed inside the fuser belt 405 are the heat application roller 401, the pad 404, the drive roller 406, and the tension guide 403. The fuser belt 405 is stretched by the heat application roller 401, the pad 404, the drive roller 406, and the tension guide 403. Note that detailed explanations on the fuser belt 405 will be given later.

The temperature sensor 412 detects the inner surface temperature of the fuser belt 405 and is provided inside the fuser belt 405. The temperature sensor 412 is provided near the entrance of the carrying path of the fuser device 40. As the temperature sensor 412, for example, a thermistor or the like can be used.

The heat application roller 401 is a roller formed of a metallic pipe for example, and rotates driven by the rotating fuser belt 405. Disposed inside the heat application roller 401 are halogen lamps 402 as heat sources. The heat application roller 401 rotates while conducting heat from the halogen lamps 402 to the fuser belt 405. As the material of the heat application roller 401, metals having high heat conductivity can be widely applied. For example, as the material of the heat application roller 401, either iron, aluminum, stainless steel, or nickel can be used. Also, the number of the halogen lamps 402 is not particularly limited. For example, one halogen lamp 402 may do, or multiple halogen lamps 402 having different heat distributions may also do. Illustrated in FIG. 1 is a case where two halogen lamps 402 are disposed.

The temperature sensor 411 detects the surface temperature of the heat application roller 401. The temperature sensor 411 is disposed in a position contacting with the surface of the heat application roller 401 to detect the surface temperature of the heat application roller 401. As the temperature sensor 411, for example, a thermistor or the like can be used. Note that the temperature sensor 411 does not need to be in contact with the surface of the heat application roller 401 as far as it can detect the surface temperature of the heat application roller 401.

The pad 404 is a belt supporting body that supports the fuser belt 405. The pad 404 forms a nip (contact part) between it and the fuser belt 405. Therefore, when a recording medium 9 is carried to between the fuser belt 405 and the pressure application belt 409 of high rigidity, the pad 404 nips the fuser belt 405 and the recording medium 9 between it and the pressure application belt 409 of high rigidity and fuses the toners 413 on the recording medium 9 onto the recording medium 9. The pad 404 is made, for example, by forming a rubber elastic layer on an aluminum core. Also, applied to the surface of the pad 404 formed of a rubber elastic layer is a fluorine-based coating for example to secure slidability of the rotating fuser belt 405.

The pad 404 is a fixed member provided inside the fuser belt 405 and may be formed with an elastic layer and a fluorine-based coating on a part of the fixed member that slides with the fuser belt 405. Also, the pad 404 may be provided with an elastic layer combined with a bias means that gives a load in a direction toward the pressure application belt 409 (for example, a direction perpendicular to the surface of the pressure application belt 409).

The support length in the carrying direction where the pad 404 supports the pressure application belt 409 through the fuser belt 405 can be arbitrarily set. For example, the pad 404 should desirably support the pressure application belt 409 supported by the below-mentioned support roller 410 and the pressure application roller 408. Therefore, the support length of the pressure application belt 409 of the pad 404 should desirably be shorter than the disposition interval length with which the support roller 410 and the pressure application roller 408 are disposed.

The drive roller 406 is a roller member that gives a rotational drive force to the fuser belt 405. The drive roller 406 is disposed in a position opposing the pressure application roller 408. When performing a fusing operation, the drive roller 406 forms a nip by contacting with the pressure application roller 408 through the fuser belt 405 and the pressure application belt 409. The drive roller 406 comprises, for example, an elastic layer on the surface of a metallic core. For the elastic layer of the drive roller 406, for example, silicon rubber, silicon sponge, or the like can be used. The elastic layer itself of the drive roller 406 may be an insulating or a conductive material. Besides, a conductive coating may be applied to the surface of the elastic layer of the drive roller 406.

The tension guide 403 stretches the fuser belt 405. The tension guide 403 contacts with and presses against the inner surface of the fuser belt 405 by springs constituting the multiple bias mechanisms 414 that are disposed along the axial direction for example, and stretches the fuser belt 405 outwards from the inner surface of the fuser belt 405. The tension guide 403 is a member made of a metal such as aluminum material or iron material.

The pressure application belt 409 is an endless belt and has enough rigidity, at least, not to deform against a load from the pad 404 it supports through the fuser belt 405. Disposed inside the pressure application belt 409 are the pressure application roller 408 and the support roller 410. Detailed explanations on the pressure application belt 409 will be given later.

The pressure application roller 408 is provided contacting with a position opposing the drive roller 406, and applies a pressure to the recording medium P carried between the fuser belt 405 and the pressure application belt 409. The pressure application roller 408 comprises an elastic layer on the surface of a metallic core for example. For the elastic layer of the pressure application roller 408, for example, silicon rubber, silicon sponge, or the like can be used. Also, the elastic layer itself of the pressure application roller 408 may be an insulating or a conductive material. Besides, a conductive coating may be applied to the surface of the elastic layer of the pressure application roller 408.

The support roller 410 is a support member that supports the rotation of the pressure application belt 409. The support roller 410 also comprises an elastic layer on the surface of a metallic core for example. For the elastic layer of the support roller 410, for example, silicon rubber, silicon sponge, or the like can be used. Also, the elastic layer itself of the support roller 410 may be an insulating or a conductive material. Besides, a conductive coating may be applied to the surface of the elastic layer of the support roller 410.

Here, the relationship between the support roller 410 and the pad 404 is explained. The pad 404 is disposed between the support roller 410 positioned in the upstream side and the pressure application roller 408 positioned in the downstream side along the carrying direction.

The support roller 410 is provided in a position where no support by the pad 404 is received through the pressure application belt 409, and for example, is disposed at a distance of about 0.5-2.0 mm from a rubber molded end face (downstream-side end face) of the pad 404.

When the main switch of the image forming apparatus 1 is OFF, the nip switching means 415 separates the pressure application roller 408 from the drive roller 406 to release the contact between the pressure application roller 408 and the drive roller 406. Also, the nip switching means 415 slightly moves the support roller 410 to release the contact between it and the pressure application belt 409.

On the other hand, once the main switch of the image forming apparatus 1 becomes ON, the nip switching means 415 moves the pressure application roller 408 that has been separated from the drive roller 406 to make the pressure application roller 408 contact with the drive roller 406. Also, the nip switching means 415 tentatively moves the support roller 410 to the drive roller 406 side, and afterwards moves the support roller 410 in the opposite direction of the carrying direction while having it support the pressure application belt 409. Thereby, in a state where the pressure application roller 408 and the drive roller 406 are in contact with each other, by moving the support roller 410 supporting the pressure application belt 409 in the opposite direction of the carrying direction, the pressure application belt 409 can be stretched, and the pressure application belt 409 and the pad 404 can be supported.

The pressure application roller 408 comprises the nip switching means 415 and can be released together with the support roller 410. Once the pressure application roller 408 is released together with the support roller 410 by the nip switching means 415, the pressure application belt 409 is also released and comes into an unsupported state with the fuser belt 405.

A conventional fuser device forms a nip part by having a pressure member disposed inside the pressure application belt 409 and applies a nip pressure of this nip part to fuse an image 413 on the recording medium P.

However, the pressure application belt 409 of this embodiment has a base material 51 that is a metallic belt of high rigidity. The rigidity of the pressure application belt 409 is of a degree not to deform by withstanding a load from the pad 404 through the fuser belt 405. Also, the rigidity of the pressure application belt 409 is higher than the rigidity of the fuser belt 405.

Figure 10:
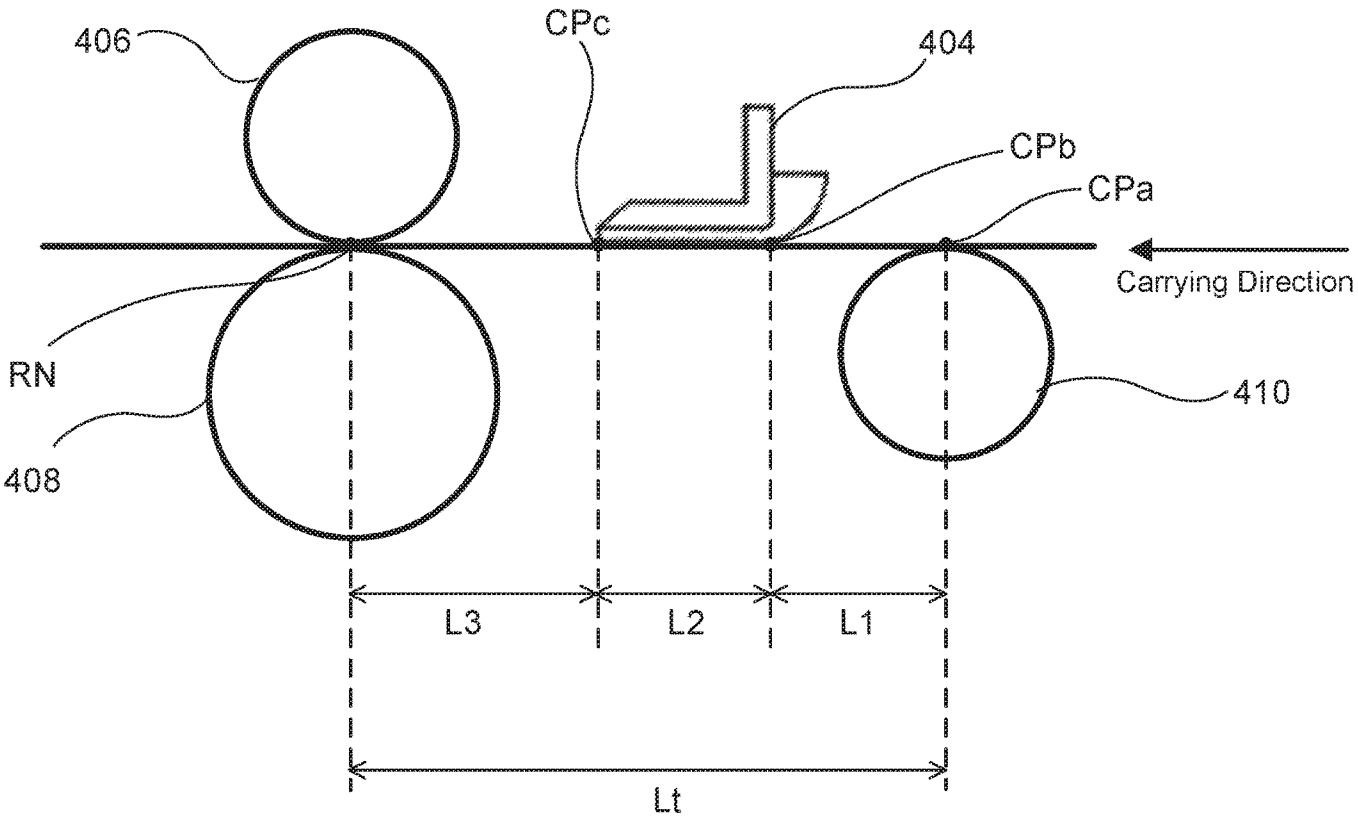
FIG. 10 simply illustrates main configuration of the invention to disclose structural relationship. The nip region above corresponds to a range of a combination of (L2+L3), which may be defined from contact CPb to roller nip RN.

Here, meant by rigidity is the fact that the pressure application belt 409 does barely deform by withstanding the load from the pad 404. To be more specific, meant is bending rigidity that the pressure application belt 409 supported by the pressure application roller 408 and the drive roller 406 has against the load from the pad 404 contacting with it, and for example, meant is the fact that little deformation such as flexure or bending occurs. The degree of the rigidity is a design matter and varies according to the specifications of the components. As an example, the belt is deformed by approximately 2 mm when Ppad, which is 1,000 gf/cm$^2$, is applied to the belt of which distance Lt is 40 mm. Distance Lt is determined by contact point CPa of support roller 410 and roller nip RN formed between drive roller 406 and pressure application roller 408. The Cpa and Lt are illustrated in FIG. 10.

Therefore, the pressure application belt 409 itself can support a support part (also called a pad nip) of the fuser belt 405 and the pressure application belt 409 formed by the pad 404.

That is, because the pressure application belt 409 has enough rigidity to withstand the load from the pad 404 without deforming, the load from the pad 404 can be supported by the pressure application belt 409. A nip is formed in the region where the pad 404 is disposed. Thereby, in a stage before the nip part between the drive roller 406 and the pressure application roller 408, pressure application and heat application become possible by the support part by the pad 404, which allows a stable fusion of toners.

In other words, there is no need to provide a pressure member for fusing images inside the pressure application belt 409 of the embodiment. Therefore, there is no longer a complex pressure mechanism as in a conventional fuser device for disposing the pressure member for applying a pressure. Also, because the pressure member is not necessary, the configuration of the fuser device itself can be miniaturized.

Also, if the pressure member presses against the drive roller as in the conventional case, due to the increase in the contact area of the pressure member, torque in driving the fuser device could increase. Also, when fusing toners on such a recording medium as an embossed sheet, abnormal noise could have occurred in driving the fuser device. However, in the first embodiment, because the support part by the pad 404 is provided utilizing the rigidity of the pressure application belt 409, torque in driving the fuser device can be better suppressed than in the conventional case, and sounding of abnormal noise can be suppressed.

Also, inside the fuser device 40, the support part of the fuser belt 405 and the pressure application belt 409 is provided by the pad 404. This support part of the fuser belt 405 and the pressure application belt 409 by the pad 404 can be regarded as a part of the carrying path. That is, the support part between the fuser belt 405 and the pressure application belt 409 can function as a nip in a part of the carrying path.

As the base material 41 of the fuser belt 405 (see FIG. 3), a base material of low rigidity is used. Therefore, when tension is given by the tension guide 403, the fuser belt 405 can reproduce a horizontal nip region along the surface of the pad 404.

Also, because the fuser belt 405 comes to follow the nip region surface of the pad 404, the support area with the heat application roller 401 is increased. Also, in order for durability not to decline due to plastic deformation by tension of the tension guide 403, as the base material 41 of the fuser belt 405 (see FIG. 3), the one having small thickness and low rigidity is suitable. Also, for the purpose of giving a constant pressure to the pad 404, as the base material of the pressure application belt 409, a specification of having large thickness and high rigidity is suitable.

Figure 3:
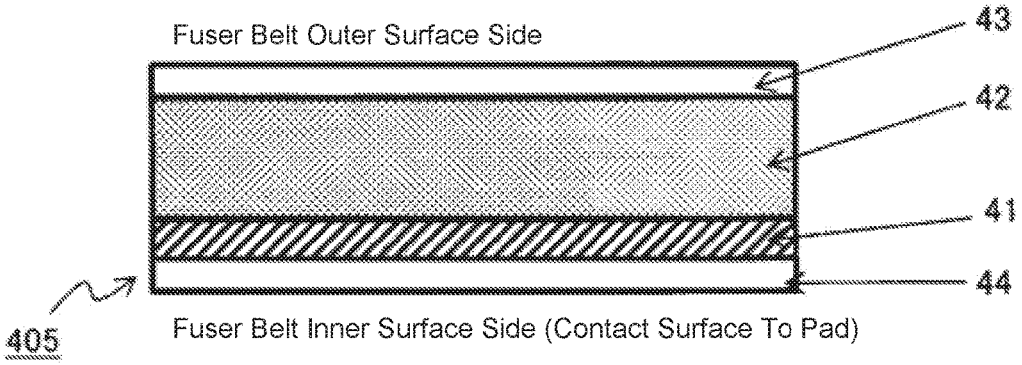
FIG. 3 is an explanatory diagram explaining the structure of a fuser belt of the first embodiment.
Figure 4:
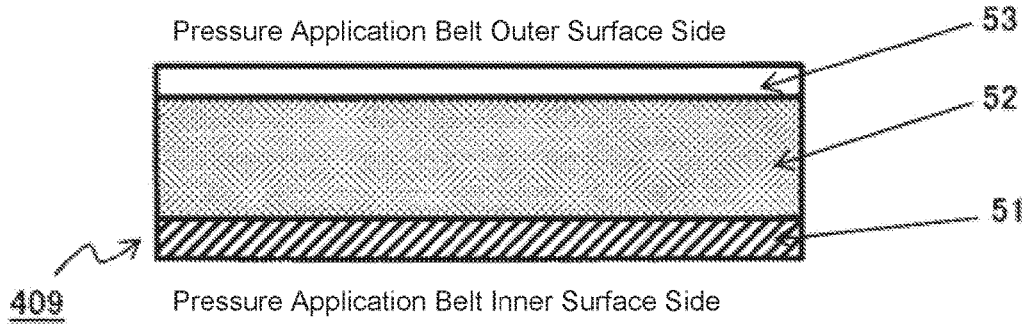
FIG. 4 is an explanatory diagram explaining the structure of a pressure application belt of the first embodiment.

Therefore, as the base material 41 of the fuser belt 405 (see FIG. 3), it is desirable to use a thinner base material than the base material 51 of the pressure application belt 409 (see FIG. 4).

FIG. 3 is an explanatory diagram explaining the configuration of the fuser belt 405 of the first embodiment. As shown in FIG. 3, the fuser belt 405 is a structure where an elastic layer 42 is stacked on one face of the base material 41. Also, formed as a thin film on the other face of the base material 41 of the fuser belt 405 is a release layer 44, and a release layer 43 is also formed as a thin film on the surface of the elastic layer 42.

As the base material 41 of the fuser belt 405, for example, a resin material such as polyimide and polyamide imide can be used. Thickness of the base material 41 is about 30-100 μm. Note that by using a resin material such as polyimide and polyamide imide as the base material 41, slidability with a metallic component provided on the inner surface of the fuser belt 405 is improved.

Note that although illustrated in this embodiment is a case where the base material 41 of the fuser belt 405 is made of a resin material such as polyimide and polyamide imide, it can be a metal such as stainless steel (SUS) and nickel. In this manner, if the base material 41 of the fuser belt 405 is made of a metallic material, in order to make the rigidity (especially, the bending rigidity) lower than that of the pressure application belt 409, it is desirable to make the base material 41 thinner than the base material 51 of the pressure application belt 409 (see FIG. 4) to reduce the cross-sectional secondary moment and reduce the rigidity (bending rigidity).

The elastic layer 42 formed on one face of the base material 41, for example, may be made of an elastic material such as silicon rubber of about 50-300 μm in order to secure low hardness and high heat conductivity. Also, the surface of the elastic layer 42 may be coated with a wear-resistant material of a low friction coefficient and high heat resistance and wear resistance in order to reduce wear due to friction with the pad 404 and secure high heat conductivity. The wear-resistant material may be a fluororesin or the like of about 10-50 μm.

The release layer 43 formed as a thin film on the surface of the elastic layer 42 releases toners on the recording medium P and is made of a resin material of high heat resistance and low surface free energy after the formation.

The release layer 43 should desirably be about 10-50 μm in thickness. For example, as the release layer 43, a representative fluorine-based resin such as PTFE (polytetrafluoroethylene), PFA (perfluoroalkoxy alkane), and FEP (perfluoroethylene-propylene copolymer) can be used.

The release layer 44 coating the other face of the base material 41 is formed as a thin film for securing slidability with the pad 404. Applied to the release layer 44 is, for example, a fluorine-based coating layer (such as PTFE, PFA, and PI).

FIG. 4 is an explanatory diagram explaining the structure of the pressure application belt 409 of the first embodiment. As shown in FIG. 4, the pressure application belt 409 has an elastic layer 52 stacked on the surface of the base material 51. Also, formed as a thin film on the surface of the elastic layer 52 is a release layer 53.

The base material 51 of the pressure application belt 409 is made of a metal such as stainless steel (SUS), nickel, iron, aluminum, and titanium alloy, and thickness of the base material 51 is about 30-300 μm, preferably about 30-150 μm. The metal for the base material 51 should desirably be a material having Young's modulus of about 70-200 GPa for example, for increasing the rigidity of the pressure application belt 409.

Here, if the base material 51 becomes thinner than 30 μm, the pressure application belt 409 could deform bent by the compressive load in the carrying direction, which is not preferable. On the other hand, if the base material 51 becomes thicker than 300 μm, the rigidity of the pressure application belt 409 becomes too high, the drive load of the pressure application belt 409 increases, the heat capacity also increases, and the warm-up time becomes longer, which is not preferable.

The elastic layer 52 formed on the surface of the base material 51 may be made of, for example, an elastic material such as silicon rubber of about 50-300 μm in order to secure low hardness and high heat conductivity, or a fluororesin or the like of about 10-50 μm in order to reduce wear by friction and secure film thinning and high heat conductivity The release layer 53 is made of a resin material of high heat resistance and low surface free energy after the formation. The release layer 53 should preferably be about 10-50 μm in thickness. For example, as the release layer 53, a representative fluorine-based resin such as PTFE (polytetrafluoroethylene), PFA (perfluoroalkoxy alkane), and FEP (perfluoroethylene-propylene copolymer) can be used. Note that between the elastic layer 52 and the release layer 53 an intermediate elastic layer made of silicon rubber or the like may be provided according to necessity.

(A-2) Operations of the First Embodiment

Next, a fusing operation in the fuser device 40 of this embodiment is explained in detail referring to drawings.

First, once the main switch of the image forming apparatus 1 is turned ON, the nip switching means 415 moves the pressure application roller 408 to have the pressure application roller 408 and the drive roller 406 contact with each other. Also, the nip switching means 415 tentatively moves the support roller 410 to the drive roller 406 side, and afterwards moves the support roller 410 in the opposite direction of the carrying direction of the recording medium P while having it supported by the pressure application belt 409.

At this time, the pressure application belt 409 is supported by the pressure application roller 408 and the support roller 410, and supports the fuser belt 405 and the pad 404 with a certain pressure by its own rigidity of the pressure application belt 409.

In the fuser device 40, the fuser belt 405 rotates driven by the drive roller 406. Along the fuser belt 405, the pad 404 is positioned in the upstream side, and the drive roller 406 is positioned in the downstream side in the carrying direction of the recording medium P.

The drive roller 406 is in contact with the pressure application roller 408 through the fuser belt 405 and the pressure application belt 409, and the pressure application belt 409 and the pressure application roller 408 are driven to rotate accompanying the driving of the drive roller 406.

Once the rotation of the fuser belt 405 starts, the heat application roller 401 heats up, and the surface temperature of the heat application roller 401 is detected by the temperature sensor 411. If this detected temperature by the temperature sensor 411 reaches a prescribed value (threshold value), it is judged that the inner surface temperature of the fuser belt 405 has reached the prescribed value. Afterwards, the recording medium P with unfused toners 413 loaded is carried up to have the fusing operation performed.

Figure 5:
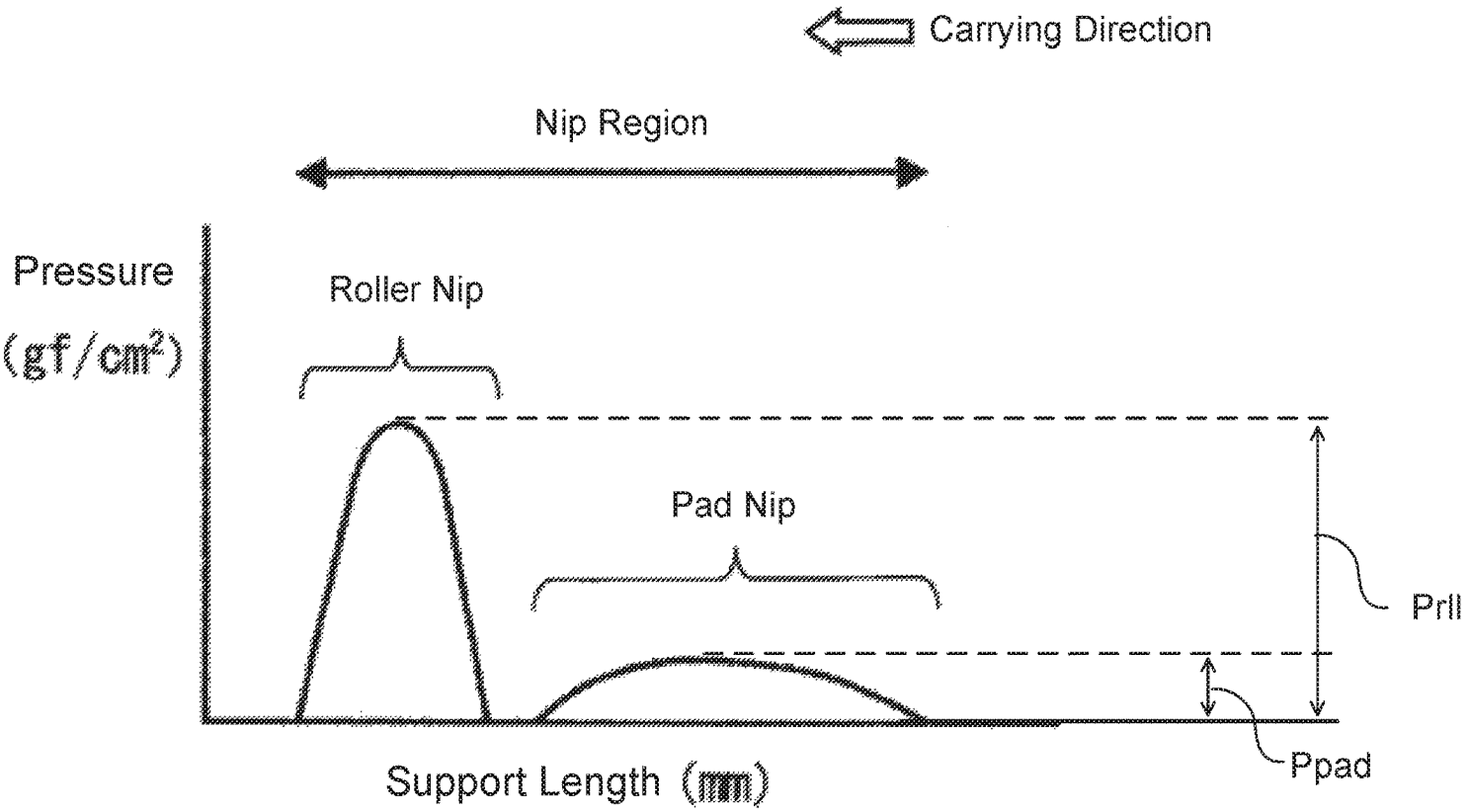
FIG. 5 is an explanatory plot showing the nip pressure distribution of a nip part in a fuser device of the first embodiment.

FIG. 5 is an explanatory plot showing the nip pressure distribution of the nip part in the fuser device 40 of the first embodiment. In FIG. 5, the direction from the right side to the left side indicates the carrying direction of the recording medium P.

Here, a nip formed by the rigidity of the pressure application belt 409 with the pad 404 in the upstream side in the carrying direction of the recording medium P as a backup is referred to as a "pad nip". Also, a nip between the drive roller 406 and the pressure application roller 408 in the downstream side in the carrying direction of the recording medium P is referred to as a "roller nip".

The pad nip is illustrated in FIG. 10 as well. Distance L2 means a length of the pad nip. It is determined from the most upstream contacting point CPb at which the pad starts contacting the belt to the most downstream contacting point CPc following which the pad separates from the belt. The roller nip is denoted with RN in FIG. 10.

The pad nip is a nip region provided near the entrance of the carrying path of the recording medium P inside the fuser device 40. Also, because the nip pressure in the pad nip region is only due to the rigidity of the pressure application belt 409, it becomes lower than the nip pressure in the roller nip region.

The unfused toners 413 and the recording medium P are heated in the pad nip region, the toners in a powder state become melted, and the melted toners start infiltrating to the surface of the recording medium P. At this time, in the pad nip region, the nip pressure is acting on the surface of the pressure application belt 409. Therefore, before the recording medium P is carried to the roller nip region, a pressure can be applied to the toners 413 and the recording medium P also in the pad nip region, which allows fusing the toners 413 to the recording medium P. Also, in the pad nip, sufficient heating becomes possible for melting the toners.

Subsequently, because the nip pressure in the roller nip region is a higher pressure than the nip pressure in the pad nip region, the toners sufficiently infiltrate the surface of the recording medium P, and at the same time, fusability of the toners is secured by applying a pressure.

As in this embodiment, in the color image forming apparatus 1, because multicolor toners of multiple layers are mixed and generate colors, a high pressure in the roller nip in the latter half where they are melted acts effectively.

As mentioned above, the pressure application belt 409 is a metallic belt of high heat conductivity, the film thickness of the pressure application belt 409 is small, and it is wound around the fuser belt 405, therefore heart is easily conducted to the pressure application belt 409.

Also, because the drive roller 406 and the pad 404 are heat insulating bodies and in contact with the fuser belt 405, reduction in the warm-up time becomes possible. Further, because the fuser belt 405 is stretched with the tension guide 403 made of aluminum or the like for example, the surface temperature of the fuser belt 405 can be heat-equalized in the axial direction.

Also, although the stretching member of a fuser belt in a conventional fuser device often functions also as a heat application roller, stretching with a roller requires both ends of the fuser belt to be stretched. As opposed to this, in this embodiment, stretching of the fuser belt 405 is performed by uniformly biasing the tension guide 403 as a heat equalization member outwards with multiple bias mechanisms 414 arranged in the axial direction from the inner surface of the fuser belt 405. Therefore, the belt tension differences over the axial direction of the fuser belt 405 become smaller and the occurrences of belt deviation becomes fewer than in the conventional stretching method by a roller.

In FIG. 5, the peak pressure values of the roller nip and pad nip are respectively denoted with Prll and Ppad. The preferred range of the pressure values are follow:

Prll: 2,000 gf/cm$^2$ to 6,000 gf/cm$^2$

Ppad: 500 gf/cm$^2$ to 2,000 gf/cm$^2$ (A-3) Efficacy of the First Embodiment

As mentioned above, according to the first embodiment, by providing the pressure application belt of higher rigidity than the fuser belt, in the upstream side of the roller nip by the pressure application roller and the drive roller, the pad nip can be formed by the pressure application belt supporting the support part formed by the pad utilizing the rigidity of the pressure application belt. Therefore, because the pad nip and the roller nip enable stable pressure application and heat application to the recording medium with unfused toners loaded, fine images with no defects can be obtained.

Also, according to the first embodiment, because the pad nip can be formed utilizing the rigidity of the pressure application belt, there is no longer any need to provide a pressure mechanism including a complex pressure member inside the pressure application belt as in the conventional case. Therefore, the fuser device and the image forming apparatus can be miniaturized, and the manufacturing cost can be suppressed.

Further, according to the first embodiment, because the thicknesses of the fuser belt and the pressure application belt can be reduced, their trackability to the pad can be improved.

Also, according to the first embodiment, because the support area for supporting the fuser belt and the pressure application belt can be expanded by the pad nip formed by the pad, the heat transfer efficiency can be improved.

According to the first embodiment, because the part of the pad contacting the fuser belt is coated with an abrasion-resistant material, drive torque in driving the fuser device can be suppressed, and sounding of abnormal noise that can occur in driving can also be suppressed.

The structural relationship between these main parts of the invention are illustrated in FIG. 10. As described above, first distance L1, which is between contact point CPa and contact point CPb, is preferred to be ranged from 0.5 mm to 2.0 mm. The contact point CPa is defined as a point where support roller 410 contacts the belt. Further, other preferred ranges of distances L2, L3, and Lt are follow:

L2: 5 mm to 15 mm

L3: 10 mm to 50 mm

Lt: 15.5 mm to 67 mm where distance L2 means a contacting surface length of the pad 404, which is in contact with the belt. Also, distance L2 may be defined as a length between two contact points CPb and CPc. Distance L3 means a distance between the pad 404 and roller nip RN. More specifically, it is determined, for example, from the downstream contact point CPc to roller nip RN. Distance Lt is determined from contact point CPa by support roller 410 to roller nip RN in the carrying direction.

(B) Second Embodiment

Next, the second embodiment of the fuser device and the image forming apparatus of this invention is explained in detail referring to drawings.

(B-1) Configuration and Operations of the Second Embodiment

As the configurations of the image forming apparatus and the fuser device of the second embodiment, the identical or corresponding configurations to the image forming apparatus and the fuser device of the first embodiment can be adopted. Therefore, in the second embodiment also, FIGS. 1-4 of the first embodiment are used for the explanations.

In the second embodiment also, once the main switch of the image forming apparatus 1 is turned ON, the nip switching means 415 moves the pressure application roller 408 to have the pressure application roller 408 and the drive roller 406 contact with each other. Also, the nip switching means 415 tentatively moves the support roller 410 to the drive roller 406 side, and afterwards moves the support roller 410 in the opposite direction of the carrying direction of the recording medium P while the support roller 410 supports the pressure application belt 409.

At this time, the pressure application belt 409 is supported by the pressure application roller 408 and the support roller 410 and also supports the fuser belt 405 and the pad 404 with a certain pressure by its own rigidity of the pressure application belt 409.

Figure 6:
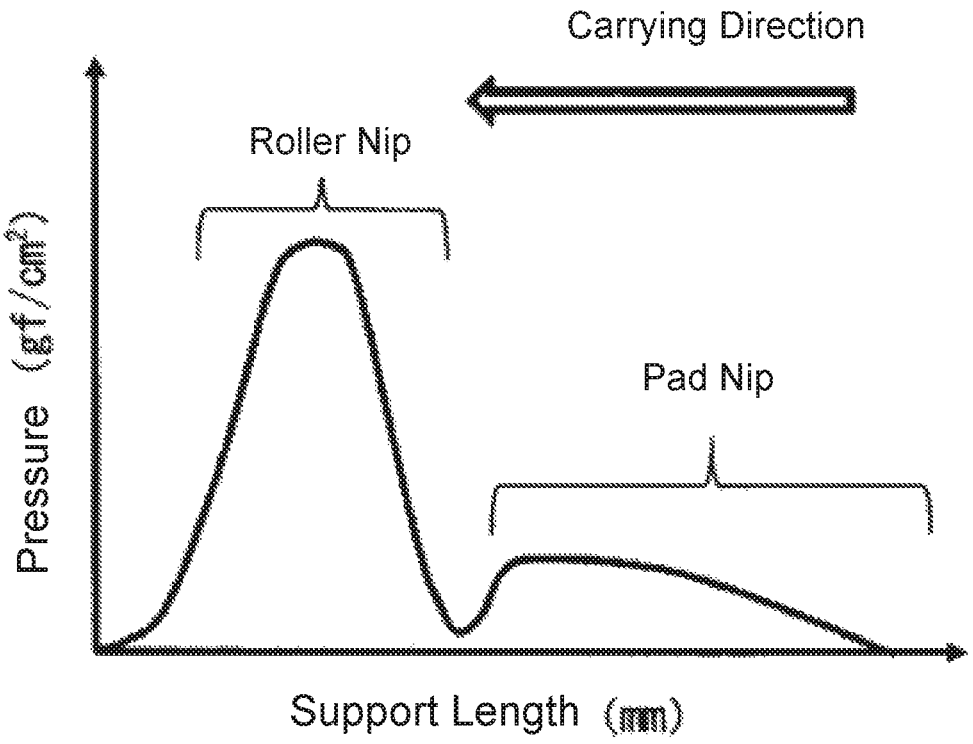
FIG. 6 is an explanatory plot showing the detailed nip pressure distribution of a nip part in a fuser device of the second embodiment.

FIG. 6 is an explanatory plot showing the detailed distribution of the nip pressure of the nip part in the fuser device 40 of the second embodiment. In FIG. 6, the horizontal axis indicates the support length (mm) of the pad 404 and the pressure application belt 409, and the vertical axis indicates the nip pressure (gf/cm$^2$). Also, in FIG. 6, the direction from the right side to the left side indicates the carrying direction of the recording medium P.

The pad nip is a nip region provided near the entrance of the carrying path inside the fuser device 40. The pad nip is formed by the rigidity of the pressure application belt 409 in contact with the pad 404. As opposed to this, the roller nip is formed by nipping the fuser belt 405 between the pressure application roller 408 and the drive roller 406. Therefore, as shown in FIG. 6, the nip pressure of the pad nip becomes smaller than the nip pressure of the roller nip.

Here, the nip pressure of the pad nip is determined by the rigidity of the pressure application belt 409 supported by the pad 404 and the fuser belt 405.

Figure 7:
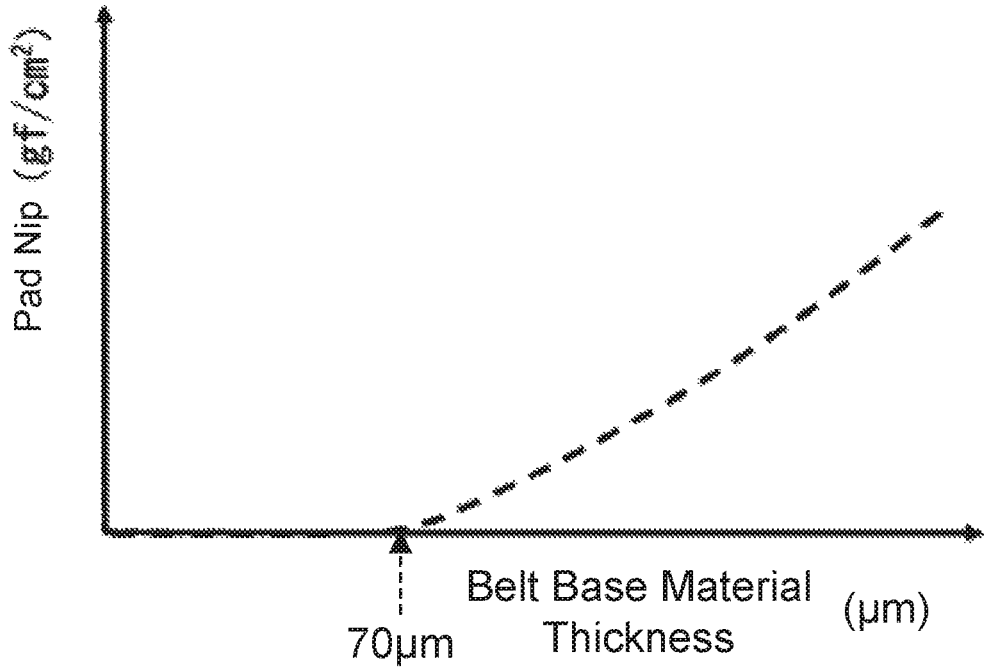
FIG. 7 is a relationship plot showing the relationship between the base material thickness of a pressure application belt and the nip pressure of a pad nip of the second embodiment.

FIG. 7 is a relationship plot showing the relationship between the thickness of the base material 51 of the pressure application belt 409 and the nip pressure of the pad nip of the second embodiment. In FIG. 7, the horizontal axis indicates the thickness (μm) of the base material 51 of the pressure application belt 409, and the vertical axis indicates the nip pressure (gf/cm$^2$) of the pad nip.

As shown in FIG. 7, it is evident that as the base material 51 of the pressure application belt 409 becomes thinner, the nip pressure of the pad nip becomes lower. For example, according to the result in FIG. 7, when the thickness of the base material 51 of the pressure application belt 409 is below about 70 μm, the nip pressure of the pad nip becomes extremely low. That is, it is evident that the pressure application belt 409 has not gained enough rigidity to withstand a load from the pad 404.

As opposed to this, it is evident that the thicker the base material 51 of the pressure application belt 409 becomes, the higher the nip pressure of the pad nip becomes.

Figure 8:
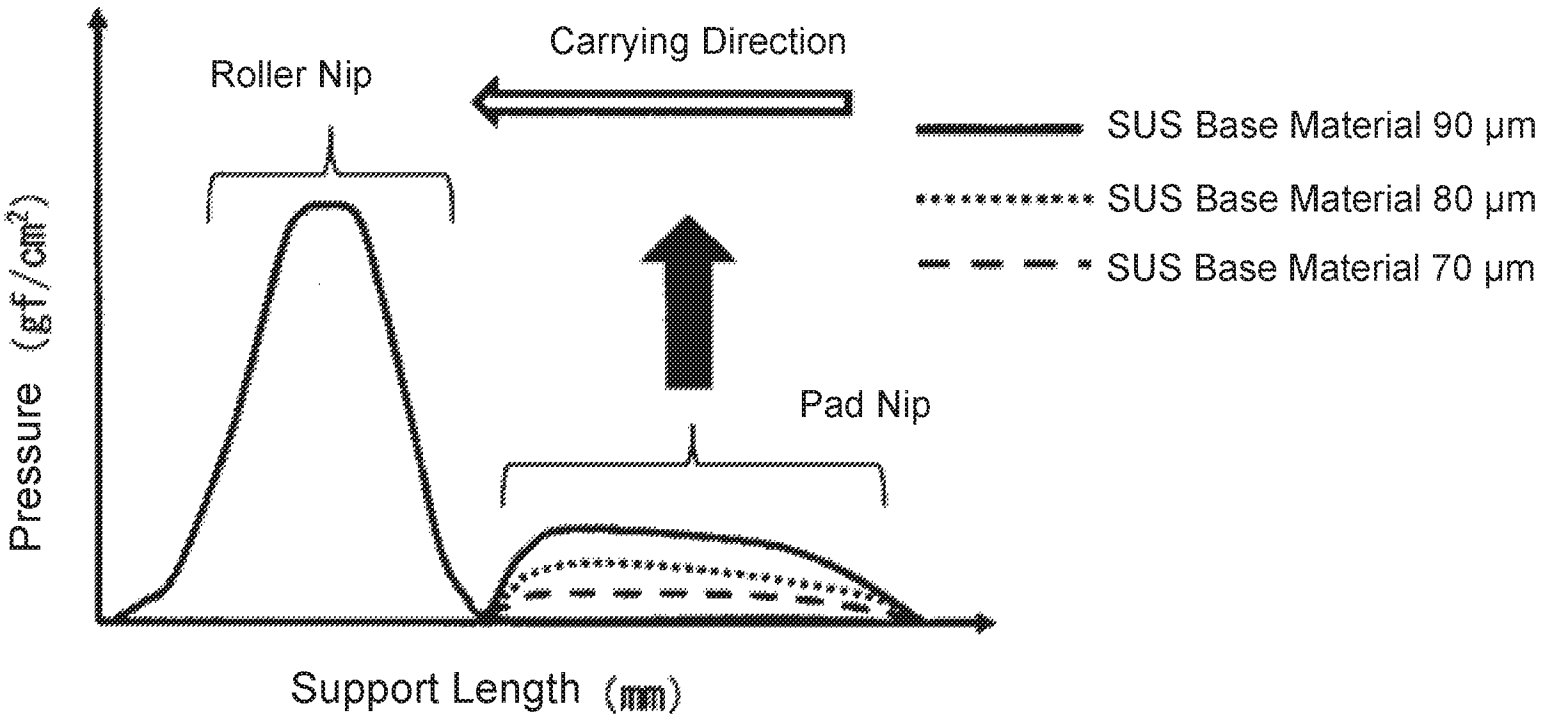
FIG. 8 is an explanatory plot showing the nip pressure distribution of the pad nip when pressure application belts of base materials having different thicknesses are used in the second embodiment.

FIG. 8 is an explanatory plot showing the nip pressure distribution of the pad nip when the pressure application belts 409 of the base materials 51 having different thicknesses are used in the second embodiment. In FIG. 8, the horizontal axis indicates the support length (mm) of the pad 404 and the pressure application belt 409, and the vertical axis indicates the nip pressure (gf/cm$^2$).

Shown in FIG. 8 is a case where SUS is used as the base materials 51 of the pressure application belts 409. Also, the thicknesses of the base materials 51 are set to 90, 80, and 70 μm. Note that the conditions such as the material and the film thickness of the elastic layer 52 and the material and the application of the release layer 53 constituting the pressure application belt 409 are set to the same for all the pressure application belts 409.

As shown in FIG. 8, in either cases of setting the thickness of the base material 51 to 90, 80, or 70 μm, a fine result was obtained in that the nip pressure of the pad nip could be made high over the entire range of the support length of the pad nip.

Also, as shown in FIG. 8, when the pressure application belts 409 having the base materials 51 of different thicknesses were used, it is evident that the nip pressure of the pad nip was the highest when the pressure application belt 409 of the base material 51 having a thickness of 90 μm, and that as the base material 51 becomes thinner, the nip pressure in the nip pad becomes lower over the entire support length range.

Based on this, by adjusting the thickness of the base material 51, the nip pressure can be adjusted over the entire support length range.

Here, if the base material 51 of the pressure application belt 409 is constituted of a metallic material such as SUS, that is, if the pressure application belt 409 is a metallic belt, as the pressure application belt 409 becomes thicker, the drive load (drive torque) of the pressure application belt 409 could increase. Also, although it depends on the type of the recording medium P, if an embossed sheet or the like having recesses and projections is used as the recording medium P for example, the embossed sheet is carried between the fuser belt 405 and the pressure application belt 409, and there may occur abnormal noise in driving the fuser belt 405.

Further, because the embossed sheet has recesses and projections, a conventional fuser device could generate uneven pressure application and uneven heat application, thereby the image quality could degrade. Especially in the case of the embossed sheet, unevenness in glossiness (that is, an image like a patchy pattern) could occur due to the recesses and projections.

As opposed to this, in this embodiment, for example, among the pressure application belts 409 having the base materials 51 of different thicknesses illustrated in FIG. 8, the pressure application belt 409 using the base material 51 of 80 μm was used.

Also, as in this embodiment, because the pad 404 and the heat application roller 401 are disposed inside the fuser belt 405, in order to support the fuser belt 405 uniformly to the pad 404, the base material of the fuser belt 405 is set thinner than the pressure application belt 409. Also, thereby, it becomes possible to gain the support area with the heat application roller 401.

(B-2) Efficacy of the Second Embodiment

As stated above, according to the second embodiment, in addition to the efficacy explained in the first embodiment, the following efficacy is achieved.

According to the second embodiment, by making the thickness of the base material of the pressure application belt larger than the thickness of the base material of the fuser belt, the rigidity of the pressure application belt can be enhanced. Also, according to the second embodiment, because the thickness of the base material of the pressure application belt is larger than the thickness of the base material of the fuser belt, the nip pressure in the pad nip can be enhanced. As a result, because stable pressure application and heat application become possible in the pad nip, high quality images can be provided.

(C) Other Embodiments

Although various kinds of modification embodiments were referred to in the explanations of the above embodiments, modification embodiments illustrated below can be further mentioned.

(C-1)

Figure 9:
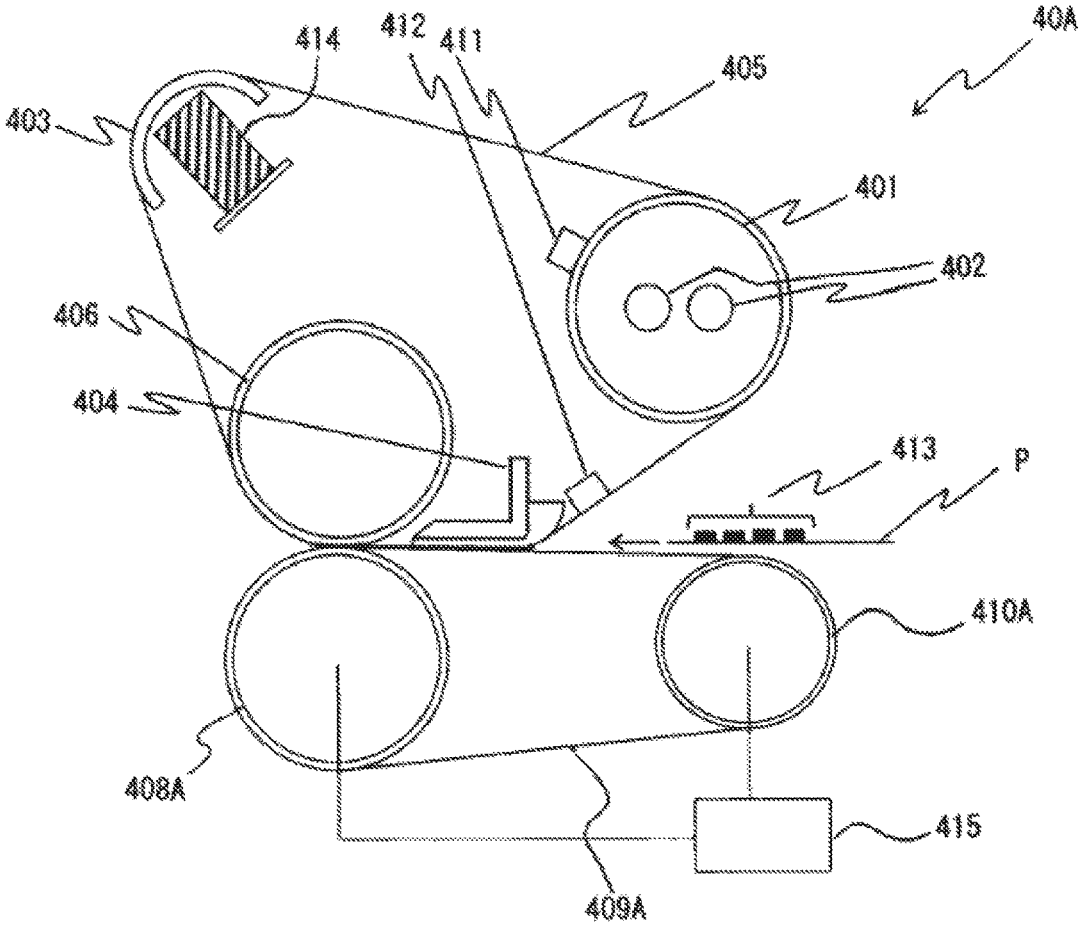
FIG. 9 is a configuration diagram showing the configuration of a fuser device of a modification embodiment.

In the above-mentioned embodiments, a case where the pressure application belt is not stretched was illustrated. However, as shown in FIG. 9, inside the pressure application belt 409, a pressure application roller 408A and a support roller 410A may have a function as a tension roller that stretches a pressure application belt 409A. In this case also, there is no longer any need to provide a pressure member to the pressure application belt 409A. Also, because the pressure application belt 409A can be stretched, the rigidity of the pressure application belt 409A in the pad nip can be enhanced. That is, even if a stronger load is applied from the pad 404 to the pressure application belt 401A (that is, even if the nip pressure of the nip pad is raised), fusing can be performed with no deformation of the pressure application belt 409A.

(C-2)

In the above-mentioned embodiments, cases where the fuser belt 405 is provided in the upper side of the pressure application belt 409 were illustrated. However, the pressure application belt 409 may be provided in the upper side of the fuser belt 405.

(C-3)

In the above-mentioned embodiments, although shown were those where the image forming apparatus is a color image forming apparatus, the technological idea of this invention can be applied to monochrome image forming apparatuses.

What is claimed is:

1. A fuser device, comprising:

a first belt that includes a first base material, a heat application member that heats an inner surface of the first belt, a fuser member that contacts the inner surface of the first belt, a nip forming member that contacts the inner surface of the first belt, a second belt that includes a second base material, and a pressure application member that contacts an inner surface of the second belt, wherein rigidity of the first base material of the first belt is less than rigidity of the second base material of the second belt, a first nip region, in which the first belt and the second belt contact, is formed in an area where the nip forming member contacts the first belt, a second nip region is formed in an area where the fuser member and the pressure application member are arranged to oppose each other, the first nip region formed by the nip forming member is formed on a upstream most side in a medium carrying direction of a belt contact region where the first belt and the second belt contact, the second nip region formed by the fuser member and the pressure application member is formed on a downstream most side in the medium carrying direction of the belt contact region, and in the first nip region where the nip forming member contacts the first belt, the second belt is free from any contact on the inner surface of the second belt.

2. The fuser device according to claim 1, wherein the second base material of the second belt is a metallic base material.

3. The fuser device according to claim 1, wherein the second belt is not stretched.

4. The fuser device according to claim 1, wherein the nip forming member is provided in a stage before a contact part of the fuser member and the pressure application member.

5. The fuser device according to claim 1, wherein surfaces of the first belt and the second belt are coated with a wear-resistant material.

6. The fuser device according to claim 1, wherein a thickness of the second base material of the second belt is larger than that of the first base material of the first belt.

7. The fuser device according to claim 6, wherein the thickness of the first base material of the first belt is 30 μm-100 μm, and the thickness of the second base material of the second belt is 30 μm-300 μm.

8. An image forming apparatus, comprising:

one or more image forming units that transfer a developed developer image to a recording medium, and the fuser device according to claim 1 that fuses the developer image on the recording medium from the one or more image forming units to the recording medium.

9. The fuser device according to claim 1, wherein the belt contact region is formed by the first nip region, the second nip region, and a third nip region provided between the first nip region and the second nip region where no element that faces the first belt or the second belt is provided.

10. The fuser device according to claim 9, wherein the first nip region, the third nip region and the second nip region are formed in order from the upstream side of the medium carrying direction.

11. The fuser device according to claim 1, further comprising:

a support member positioned on the upstream side of the pressure application member in the medium carrying direction, wherein $$Lt>L2$$

is satisfied, where L2 is a length of the first nip region, and Lt is a distance between a contact part between the support member and the second belt on the upstream most side of the medium carrying direction and a contact part between the pressure application member and the second belt on the downstream most side of the medium carrying direction.

12. The fuser device according to claim 1, wherein the first nip region is formed only by the nip forming member, the second belt and the first belt being sandwiched by the nip forming member and the second belt.

13. The fuser device according to claim 1, further comprising:

a bias member positioned to contact the inner surface of the first belt, wherein the first belt is stretched by the fuser member, the heat application member, the nip forming member and the bias member.

14. The fuser device according to claim 1, further comprising:

a carried medium first contacts the first nip region.

15. The fuser device according to claim 1, wherein the nip forming member is a non-moving component.

16. The fuser device according to claim 1, wherein the nip forming member includes a round section and a planar section that extends parallel with the medium carrying direction.

17. The fuser device according to claim 1, further comprising a support roller that contacts the inner surface of the second belt, wherein a separation part, at which the support roller is separated from the inner surface of the second belt, is provided on the upstream side of the first nip region in the medium carrying direction.

18. The fuser device according to claim 17, wherein the separation part is spaced away from a contact part between the nip forming member and the first belt.

* * * * *